United States Patent [19]

Eventoff et al.

[11] 4,306,480

[45] Dec. 22, 1981

[54] ELECTRONIC MUSICAL INSTRUMENT

[76] Inventors: Frank Eventoff, 2351 Lakeview Ave.; Serge A. Tcherepnin, 1448 Angeles Ave., both of Los Angeles, Calif. 90026

[21] Appl. No.: 782,431

[22] Filed: Mar. 29, 1977

[51] Int. Cl.[2] ..... G10H 1/00; G10H 3/00

[52] U.S. Cl. ..... 84/1.01; 84/1.16; 84/1.19; 84/1.24; 84/DIG. 9; 84/DIG. 24

[58] Field of Search ..... 84/1.01, 1.14, 1.15, 84/1.16, 1.24, 1.25, DIG. 7, DIG. 9, 1.19, DIG. 10, DIG. 24

[56] References Cited

U.S. PATENT DOCUMENTS

| | | | |
|---|---|---|---|
| 2,792,738 | 5/1957 | Donahue | 84/1.16 |
| 3,609,203 | 9/1971 | Adachi | 84/DIG. 10 |
| 3,662,641 | 5/1972 | Allen | 84/1.16 |
| 3,742,114 | 6/1973 | Barkan | 84/1.16 |
| 3,795,756 | 3/1974 | Suzuki | 84/1.25 |
| 3,842,358 | 10/1974 | Frazier | 307/233 R |
| 3,940,693 | 2/1976 | Brown | 307/295 |
| 3,948,137 | 4/1976 | Niinomi | 84/1.01 |
| 3,965,789 | 6/1976 | Pearlman | 84/1.25 |

FOREIGN PATENT DOCUMENTS

| | | | |
|---|---|---|---|
| 374721 | 5/1973 | U.S.S.R. | 328/35 |

OTHER PUBLICATIONS

Ward, Electronic Music Circuit Guidebook, 1975, pp. 154–158.

Frederiksen et al., "The LM3900 . . . ", in Linear Applications, vol. 1, published by National Semiconductor, p. AN72-23, Sep. 1972.

Foord, Voltage Controlled Oscillator, in Radio and Electronics Constructor, vol. 28, No. 10, pp. 590–595, May 1975.

*Primary Examiner*—J. V. Truhe

*Assistant Examiner*—Forester W. Isen

*Attorney, Agent, or Firm*—Nilsson, Robbins, Dalgarn, Berliner, Carson & Wurst

[57] ABSTRACT

An electronic musical instrument having a fret board and a plurality of conductive frets may be coupled to a resistance ladder of discrete resistive elements. A conductive wire or a plurality of such wires selectively making contact with at least one of the conductive frets forms, together with the resistance ladder, part of a tone generating circuit. The circuit includes an oscillator which generates a tone in response to the conductive fret with which the wire makes contact. The circuit may also include a wave shaping circuit which selectively alters the shape of the generated tone and through a series of gradations alters its operating characteristics from that of a full wave rectifier to a linear voltage follower. Another embodiment modulates the phase of the generated tone by exploiting the dynamic impedance of a diode. One or more unique pressure sensitive touch pads may be employed for a glissando effect and/or for volume and/or tone glides. The instrument includes a single chromatic semitone switch and may be tuned to any key by a variable control. The circuit may also include variable vibrato, timbrato and tremolo effects. Inclusion of an octave switch and variable tuning between frets is also possible.

11 Claims, 9 Drawing Figures

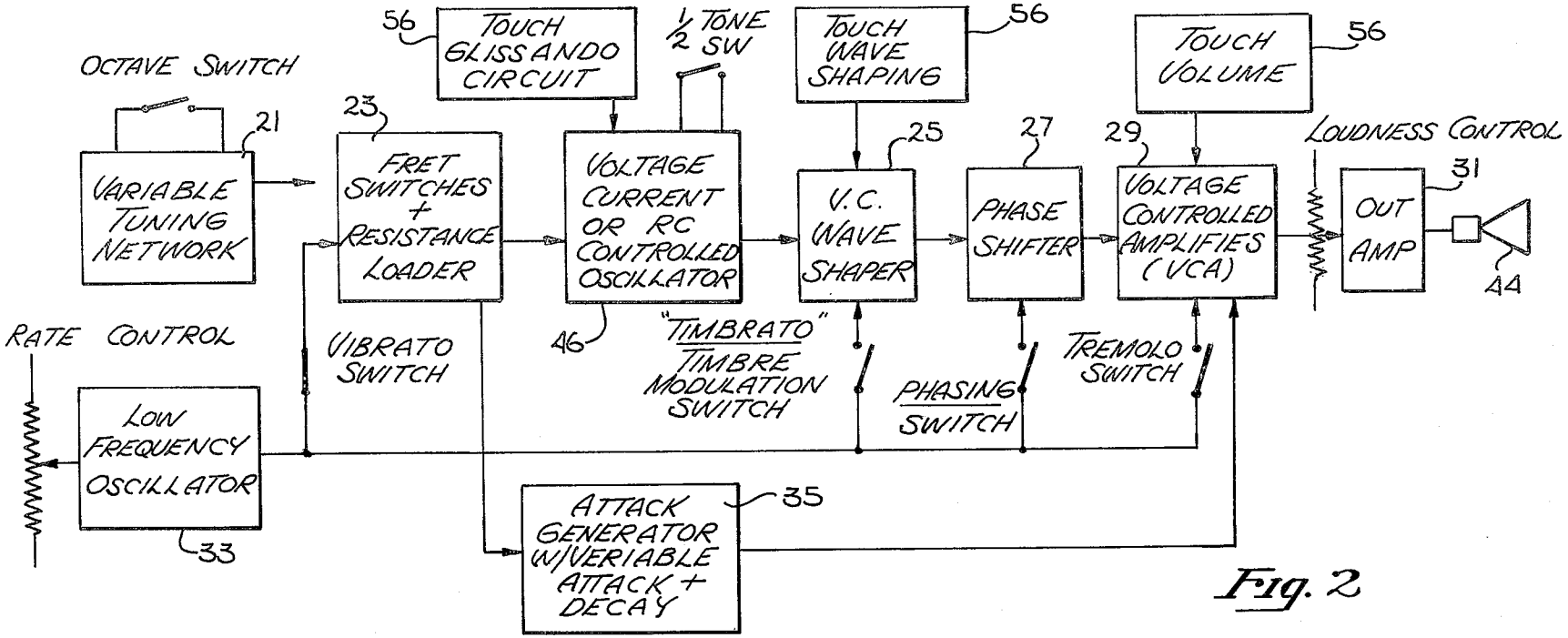
Fig. 2
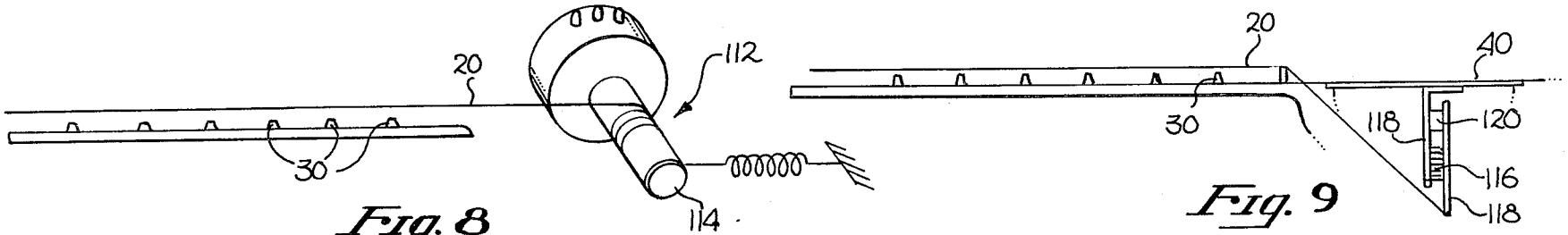
Fig. 8
Fig. 9

ELECTRONIC MUSICAL INSTRUMENT

BACKGROUND OF THE INVENTION

1. Field of Invention

The present invention relates to the field of electronic musical instruments and in particular, electronic musical instruments including stringed electronic musical instruments.

2. Description of the Prior Art

Electronic stringed instruments are well known to the art and are experiencing an increasing acceptability both among performers and listeners. However, the construction and design of such electronic stringed instruments have been of such a nature and complexity that instruments of such quality have remained relatively costly and economically unattractive to the toy and hobby markets.

In addition, where such stringed instruments have used linearly spaced fingering along a board similar to a fret board in a conventional guitar, the fingering has employed the use of separate mechanical switches or push-buttons, U.S. Pat. No. 3,555,166, or has employed a continuous resistive element to obtain fret-like fingering, U.S. Pat. Nos. 3,624,583, and 3,699,492. In addition, such electronic instruments have involved wave shaping or tone control which have been frequency dependent. In other words, the amplitude of the tone as affected by the tone control is dependent upon the frequency or the principal frequency of the tone. Finally, addition of enhanced musical effects such as glissando, vibrato, timbrato, tremolo and others have been achieveable only at high cost and complexity. Therefore, what is needed is a simple, inexpensive electronic instrument which will simulate conventional fret board fingering, which incorporates a tone control circuit which shall be substantially frequency independent, and which can be modified to incorporate complex and sophisticated musical qualities.

BRIEF SUMMARY OF THE INVENTION

The present invention is an electronic musical apparatus comprising a sounding box, a fret board coupled to the sounding box and a plurality of discrete frets disposed on the fret board. A plurality of discrete resistive elements are coupled to the plurality of discrete frets. A first means employed for generating a plurality of tones is coupled to the plurality of resistive elements. A source of electrical power is coupled to a conductive means disposed on the fret board, which conductive means is adapted to selectively couple the source of electrical power to at least one of the plurality of discrete frets. By virtue of the above combination, musical tones may be audibly generated according to a fixed musical scale in a functionally equivalent manner to conventional stringed instruments.

The present invention further includes a second means which has its input coupled to the output of the first means. The second means is employed for selectively modifying the frequency spectrum and/or wave shaping the plurality of tones generated by the first means. The second means alters the frequency spectrum of the plurality of tones without substantial alteration of the amplitude of the tone regardless of the frequency of the generated tone.

The second means may also modify the wave shape of the plurality of tones by acting on the tone wave shape as a full wave rectifier at one extreme, and through a series of continuous gradiations, as a linear voltage follower at the other extreme.

Means may also be included to modulate tone, volume and pitch either in a periodic fashion or in a random glide, such as produced by a manually applied pressure.

The present invention and its various embodiments may be better understood by viewing the following figures.

BRIEF DESCRIPTION OF THE DRAWINGS

FIG. 2 is a schematic illustrating one embodiment of the present invention wherein pitch, tone and volume may be periodically or randomly varied.

FIG. 8 shows one embodiment of the present invention wherein the string is coupled to a potentiometer to produce a glissando effect.

FIG. 9 shows another embodiment wherein the string is combined with a piezo resistive element to produce a glissando effect.

DETAILED DESCRIPTION OF THE PREFERRED EMBODIMENTS

The present invention is a musical instrument which may be economically fabricated so as to be adaptable to both the market of the performing arts and the hobby and toy markets. The present invention uses a discrete resistance chain which permits conventional finger board keying of each of the tones in a chromatic scale. The circuitry of the present invention may further include a unique wave shaper and tone, pitch and volume control circuit which is able to modify the wave shape of the tones generated by the instrument in a manner which is substantially independent of the frequency of the tone. By virture of this tone control circuit waveshape, modification may be achieved with a high degree of uniformity and controllability and at heretofore unachievable costs. In addition, a unique pressure sensitive element may be employed to provide pitch, tone and volume glides. These, and other advantages of the present invention, are best understood by viewing FIGS. 1–6.

Figure 1:
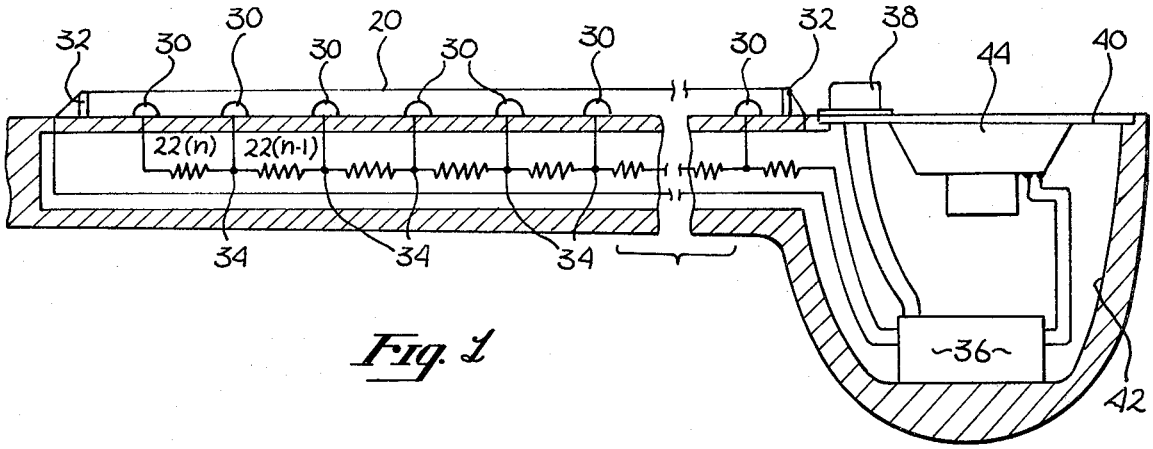
FIG. 1 is a cross sectional of one embodiment of the invention showing the manner in which a conductive wire may be used to selectively couple a discrete number of resistive elements to the tone generating circuit.

FIG. 1 is a cross sectional view of one embodiment of the present invention showing a fret board 28 on which a plurality of conductive frets 30 have been disposed. Each fret 30 is coupled to a nodal point between two discrete resistive elements with which other similar elements form an ordered series of "n" resistive elements 22(1), 22(2), . . . 22(n) or a resistance ladder. One end of the resistance ladder is coupled to a circuit 36, described below, for generating the desired tones. It is to be understood however, that the discrete resistance elements may be replaced by continuous resistance or ribbon resistance elements well known to the art.

A conductive string or wire 20 is stretched above frets 30 along fret board 28. String 20 may be depressed to selectively contact one of frets 30. One end of string 20 is also coupled to circuit 36, typically a source of variable voltage included in circuit 36.

Again, it must be expressly understood that the fret board and string combination may be replaced by equivalent conductive means such as momentary contacts, mechanical and electronic switches, hammer, fret and string combinations, capacitance switches, optical switches (e.g. LED switches), piezo-resistive elements, force sensitive diodes, and similar devices. In the case of a string and fret board combination, it must also be understood that a multiple number of electrically isolated strings and resistance ladders may be duplicated to simulate a conventional multistringed instrument. In the following description, a single string and fret board combination will be described together with a discrete resistance ladder although it is assumed that any of the preceding devices and combinations could be substituted for its equivalent or duplicated.

Circuit 36 further may include an oscillator, power supply controls and speaker contained on or within a sounding box 42. A tone, pitch and volume control circuits as described hereinafter may also be included. A large variety of oscillator circuits, including those discussed in the following, may generate the desired tones in response to the voltage or current coupled to an input node. In such cases, it is observed that the frequency or principal frequency of the tone is proportional to the input current. Such a current is delivered through the selected portion of resistance ladder 22(1), 22(2) . . . (n) or its equivalent. Thus, the frequency is inversely proportional to the selected impedance of the resistance ladder. Therefore, in conformity with a conventional stringed instrument, first resistance element 21(1) of the resistance ladder is coupled to the fret closest to sounding box 42. Additional resistive elements 22 are then added serially in discrete jumps with each fret 30 on fret board 28 as one moves away from sounding box 42. The resistance values can be chosen by proportioning the ratio of the increase on the total selected resistance to be equal the 12th root of 2 for a semitone and twice the 12th root of 2 for a whole tone. In other words, the desired frequency jumps may be chromatically proportioned if each of the resistive elements are selected, according to design choice, and according to the following ratio.

$$\frac{F(i)}{F(i+i)} = \frac{R(1)\,R(2) \ldots R(i)\,R(i+i)}{R(1)\,R(2) \ldots R(i)} = \frac{2}{2} \qquad (2)$$

Figure 4:
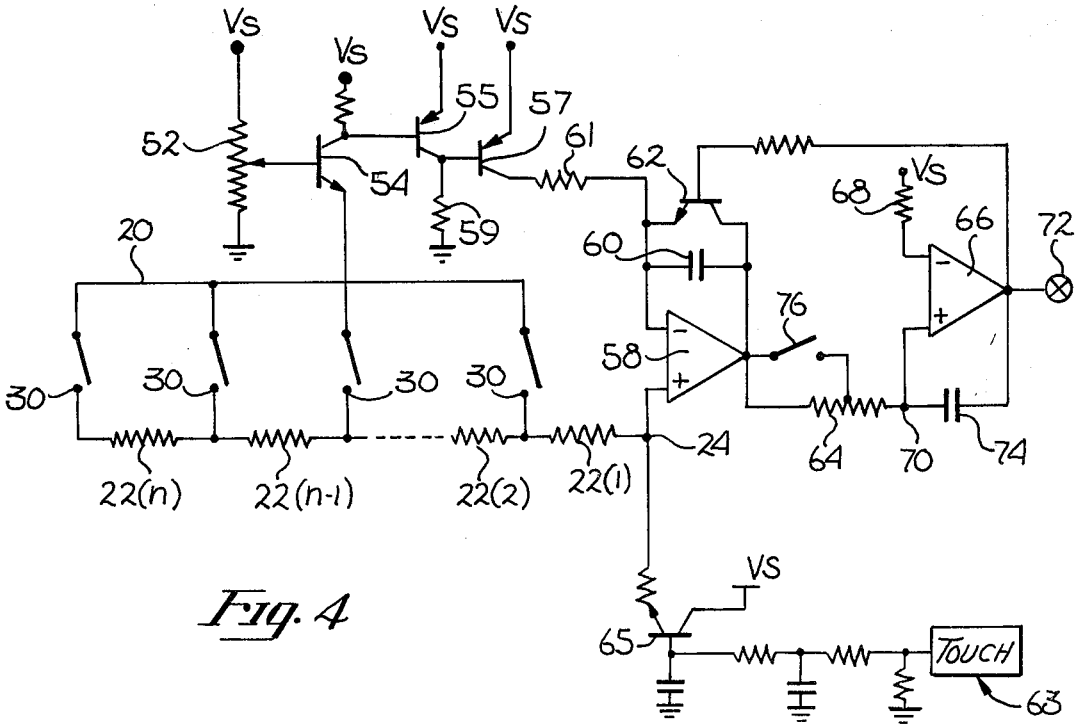
FIG. 4 illustrates another embodiment of the present invention in which the oscillator is replaced by a resettable integrating oscillator.

Therefore, it can be easily understood that the basic frequency of the circuit of FIG. 4 may first be fixed. Thereafter, if a given scale is desired, the value of succeeding resistive elements 22 are chosen according to the preceding formula according to the ratios of frequencies found in that scale. Circuit 36 may also contain an internal frequency control, well known to the art, whereby the basic frequency produced by oscillator 46 when the resistance value of resistive element 22(1) is chosen, may be varied. Such a control constitutes a pitch control whereby the fret board may be selectively fixed at any key. In addition, conventional tone and volume controls may be included within circuit 36 to enable user adjustment of both the volume and timbre of the musical instrument. Although the discrete resistance ladder has been described as being comprised of fixed resistive steps, it is entirely within the scope of the present invention that the resistance or frequency step between each fret may be variable. This will allow for precision tuning as well as tuning to nonconventional and novel scales or keys. In the presently preferred embodiment, the fret board is tuned to produce a major and minor scale, although any scales and number of octaves well known to the art may easily be included on the fret board range.

FIG. 1 illustrates one embodiment of the present invention. Conductive string 20 may be selectively coupled to any one of the plurality of resistive elements 22(1), 22(2), . . . 22(n). In this manner, the voltage delivered from power supply Vs through string 20 and resistive elements 22 may be selectively varied in discrete steps. String 20 may be in a conductive wire, such as a piano string, which is lightly stretched along a fret board 28. String 20 is elevated a small distance above a plurality of frets 30 by means of conventional bridges 32. As shown both in FIG. 1, frets 30 are coupled to nodal points 34 which interconnect each of resistive elements 22 in the resistance ladder. String 20 is coupled to circuit 36, which is understood to include external controls, such as switches and potentiometers, which are conveniently mounted to permit manual manipulation by the player. Such controls may be mounted anywhere on the instrument and may best be mounted on a facing plate 40 which forms the upper surface of a sounding box 42. Sounding box 42 is used to enclose circuit 36 and speaker 44. The shape of sounding box 42 may simulate any instrument shape well known to the art and in particular, may combine well known principles of accoustics to provide an efficient speaker enclosure.

FIG. 2 illustrates a simplified diagramatic view of one embodiment of the present invention. A variable tuning network 21 which may include a network such as resistance 52 in combination with transistor 54 as shown in FIG. 4, provides a variable voltage to a plurality of fret switches and resistance ladder 23 which includes resistance ladder 20 of FIGS. 1 and 3 and their various equivalents. Fret and resistance ladder 23 may be coupled to a current controlled or RC controlled oscillator 46 well known to the art. As described below in greater detail, a unique pressure sensitive or touch glissando device 56 may be coupled to oscillator 46 to provide pitch glides according to a random or manual control. Oscillator 46 may also include a chromatic half tone or semitone switch which will shift the output tone of oscillator 46 one half tone above the base tone as determined by the resistance of frets selected in fret resistance ladder 23. The output of oscillator 46 may be coupled to a voltage controlled wave shaper 25, as described below, which also may include a similar touch or pressure sensitive device 56. The output of the voltage controlled wave shaper 25 may similarly be coupled to a voltage controlled phase shifter 27 as described below. The output of phase shifter 27 may be coupled to the input of a voltage controlled amplifier 29 well known to the art. As before, the voltage controlled amplifier may also include within its circuitry a touch or pressure sensitive volume control element 56 to produce random or manually controlled volume glides. Finally, the output of the voltage controlled amplifier may be coupled to an audio amplifier 31 well known to the art having a speaker output 44. A subsonic or low frequency oscillator 33 whose output frequency may be selectively coupled to fret resistance ladder 23, wave shaper 25, phase shifter 27, and voltage controlled amplifier 29. In each case, oscillator 33 will inject a subsonic modulation voltage which will provide a musically enhanced effect. For example, when coupled to fret resistance ladder 23, the result is a vibrato or periodic variation of pitch which will be generated by oscillator 46 in response to the modulating frequency coupled through fret and resistance ladder 23. When coupled to wave shaper 25, a timbrato or periodic modulation of tone or timbre will be reflected in the output of wave shaper 25. When coupled to phase shifter 27, a subsonic variation of phase having an audio effect well known to contemporary musicians termed "phasing" will be reflected in the output of phase shifter 27. Finally, a coupling of the subsonic frequency from oscillator 33 to voltage controlled amplifier 29 will result in a tremolo or a periodic modulation of amplitude according to means well known to the art. In addition to subsonic variable modulation, the circuitry of FIG. 2 may include an attack generator 35 which generates a saw tooth output having a variable rising and decaying slope. The input of attack generator 35 may be coupled to fret resistance ladder 23 such that attack generator 35 is keyed or generates an output whenever a note is keyed on the fret board. The saw tooth output, having variable rising and decaying slopes, is coupled to voltage controlled amplifier 29 in order to modulate the envelope of the generated tone according to principles well known to the art. Thus, by varying the attack and the decay slope in the output of generator 35, a wide variety of sonic effects may be created including bell-like tones which which are characterized by sharp attack and slow decay, brass-like effects, which are characterized by medium attack and medium decay, and various synthesized electronic effects such as characterized by a long attack and a short decay.

Figure 3:
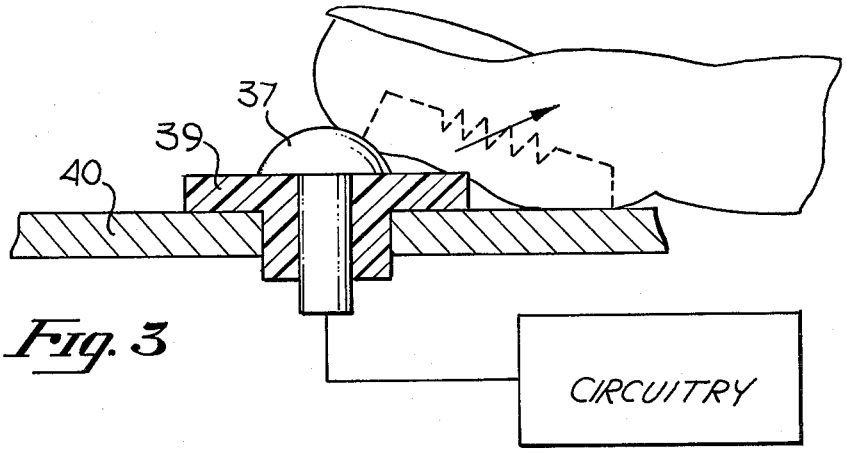
FIG. 3 is a cross sectional, diagrammatic view of one embodiment of a pressure sensitive element of the present invention.

FIG. 3 illustrates a unique pressure sensitive element which may be used as the touch or pressure sensitive device 56 in FIG. 2. A rivet 37 is insulatively spaced by a washer 39 from the conductive face place 40 of the musical instrument. In the presently preferred embodiment, face plate 40 is electrically coupled to string 20 and thus forms part of the fret and resistance ladder 23. Typically, rivet 37 is electrically coupled to the power supply, Vs. When the player manually places a finger in contact with the rivet and in overlapping contact with conductive face plate 40, a resistive electrical circuit is formed through the skin contact resistance of the abridging portions of the finger. The degree of electrical resistance may be varied by varying the amount of pressure between the finger and rivet 37 and/or face plate 40. Similarly, while the player maintains contact with rivet 37 with one hand, a similar glissando effect may be created by varying the pressure of the fingers of the other hand with the depressed portion of string 20 which is electrically coupled to face plate 40. The manner in which the pressure sensitive device of FIG. 3 may be used to modulate pitch, tone and volume, may be better understood by viewing the circuitry of FIGS. 4–7.

In one embodiment, oscillator 46 may be a conventional RC controlled oscillator in which resistive elements 22, together with a capacitor, provides a discretely variable tank circuit according to the particular fret 30 with which string 20 makes contact. The frequency of the tone generated by oscillator 46 will largely be determined by the voltage to which the capacitor is charged. Thus, the value of resistance elements 22 and resistor 26 will determine the charging rate of capacitor 50. When the polarity of string 20 is driven in an opposite direction as determined by oscillator 46, the capacitor will discharge through the selected resistance elements 22, not including resistor 26. Therefore, in addition to having an exponentially shaped wave form both on the charging and discharging slopes, the slopes will have an unequal rate and the output of oscillator 46 will thus be in a generally triangular form. The principal frequency of the output of oscillator 46 will be inversely proportional to twice the total resistance value selected from the resistance ladder plus resistance 26 times the value of the capacitor. Thus, the lowest resistance produces the highest frequency. The various resistance values may then be selected according to the ratios discussed above.

FIG. 4 illustrates another embodiment of the present invention wherein oscillator 46 is not an RC controlled oscillator but is a current controlled, self-reset linear integrator. The resistance ladder, and string 20 are configured and proportioned in a similar manner as previously discussed in reference to FIG. 2. FIG. 4, in addition, shows a variable pitch control which may be comprised of resistor 52 and transistor 54. In the embodiment illustrated, transistor 54 is shown as having its collector coupled to the power supply, Vs, and its emitter coupled to string 20. The base of transistor 54 is supplied with a variable current drawn from variable resistor 52 which is also coupled between VS and ground. Therefore, the current supplied to node 24 for any given selection of resistance elements 22, may be varied by the setting of potentiometer 52. In a practical circuit, undesired low frequencies or clicking may be produced if the string to fret contact is poor, as may be the case when the string is pressed against the fret with a low pressure. Transistors 55 and 57, together with biasing and limiting resistors 59 and 61 provide a low biasing current to the integrating oscillator which discharges the output of amplifier 58 toward ground whenever transistor 55 conducts, which in turn is forward biased only when transistor 54 is conducting. The small negative or discharging bias provided by transistor 57 through resistor 61 is easily overcome when a good contact is made between string 20 and a fret. In that case, a controlling amount of current is supplied to the positive input of amplifier 58.

In addition, a portamento control may be provided by a pressure sensitive resistive element 56 coupled to Vs. The element of FIG. 3 may be combined with a standard filter 63 to filter out unwanted stray pick-up voltages to drive transistor 65. As previously described, the current supplied through transistor 65 to node 24 can be varied by the degree of pressure exerted between rivet 37 and a player's finger which is also coupled to another voltage bearing element such as string 20 or plate 40. It must be explicitly understood that various additional resistive or passive elements and networks may be added both to the resistance ladder to a circuit which includes potentiometer 52 and transistor 54, as well as to pressure sensitive resisting element 56 without departing from the scope or spirit of the present invention. The embodiment is illustrated in simplified form only for the purposes of illustration.

Node 24 is coupled to the positive input of a current differencing operational amplifier 58, well known to the art. Amplifier 58 may include such well known amplifiers as LM3900 or MC3401p. An integrating capacitor 60 is coupled between the output and the inverting input of amplifier 58, thereby forming a linear intergrator whose integration constant is determined by the selected value of resistance of the resistance ladder. The output of amplifier 58 is coupled to a level detecting monostable trigger circuit composed of resistors 64 and 68, amplifier 66, and a positive feedback capacitor 74 determining the duration of the trigger pulse to be found at output 72. As the ramp voltage increases at the output of amplifier 58, it translates into a rising current determined by the value of resistor 64. The current through resistor 64 is compared by current differencing amplifier 66 to a reference current determined by resistor 68 coupled to Vs. When equality is reached, amplifier 66 enters a positive feedback regenerative cycle through capacitor 74 and produces a pulse at output 72. This pulse resets through transistor action of transistor 62 the integrator formed by amplifier 58 and associated parts, and returns the integrator to a low voltage state, able to begin a new integrating cycle. As a net result, a ramp-like, repetitive sawtooth is generated at the output of amplifier 58.

It must be understood that many alterations and modifications may be made to the details of the circuit shown in FIG. 4, such as adding additional active and passive elements, well known to the art, according to common design principles, without departing from the scope of the invention. The circuitry has been illustrated in simplified form only for the purposes of clarity and illustration. One such addition may include a provision for increasing the frequency produced by the circuit by a semitone. For example, in FIG. 3, a switch 76, which may be a push-button switch may be added as part of controls 38, shown in FIG. 1, and may be coupled between the output of amplifier 58 and tapped from an appropriate point of resistor 64. In practical situations, resistor 64 will, in fact, be comprised of two discrete elements having values selected for this purpose. In the circuit illustrated in FIG. 3, it can be shown that the frequency generated at the output of amplifier 58 is inversely proportional to resistor 64. Therefore, by shorting out a portion of resistor 64 such that the ratio of the partial resistance remaining in the circuit, after the actuation of switch 76, to the total value of the resistance is equal to the 12th root of 2, the output frequency of the circuit may be raised by a semitone. Output 72 may then be coupled to an audio amplifier and speaker as shown in FIG. 2 or may be subject to further wave shape modification and alteration.

Figure 5:
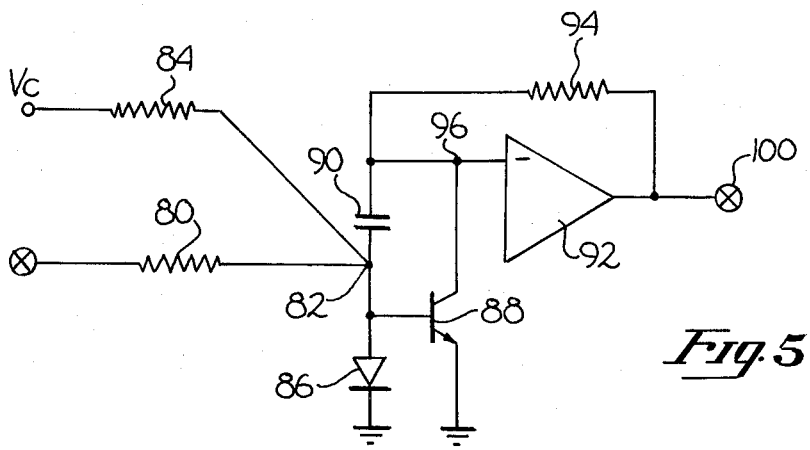
FIG. 5 illustrates one embodiment of a voltage controllable phase shifter wherein a capacitor is used to couple the inverted input of an amplifier to a current node.

FIG. 5 illustrates one such circuit which provides a unique means for altering the phase of the periodic electric signal generated by the circuitry of FIGS. 2 or 3 or other circuitry (voltage controlled phase shifter 27). The periodic signal is coupled through capacitor 78 and resistor 80 to node 82. Node 82 is also biased through resistor 84 which is coupled to a variable source of voltage well known to the art such as a subsonic oscillator 33. Node 82 is coupled to ground through diode 86. Similarly, node 82 is coupled to the inverted input of an amplifier 92 through capacitor 90. Amplifier 92 is provided with a feed back resistor 94. Node 96 is similarly coupled to the inverting input of amplifier 92, capacitor 90 and the collector of transistor 88. The base of transistor 88 is coupled to the anode of diode 86 and has its emitter coupled to ground.

The operation of the circuit of FIG. 5 may be understood as follows. A positive going AC current coupled through capacitor 78 and resistor 80 to node 82 is coupled through forward biased diode 86 to ground. As is well known to the art, the dynamic resistance of diode 86 is inversely proportional to the current flowing through it. Thus, the variable voltage Vc, applied to node 82 sets the center frequency, as described below, by setting the center of the dynamic resistance of diode 86. Positive currents flowing through capacitor 78 and resistor 80 to node 82 will thus be split through the impedance of capacitor 90 and diode 86. It has been observed that frequency components higher than R (dynamic)C(90) find a lower impedance path and are increasingly coupled through capacitor 90 to summing node 96. Frequency components lower than that center frequency tend to find a lower impedance path through diode 86 and therefore are increasingly coupled to ground across diode 86. Input diode 86 and transistor 88 form a current mirror well known to the art of integrate circuit manufacture, and embodied, along with amplifier 92, in such low cost devices as the LM 3900 and MC3U01p.

One of the unique factors of the circuit of FIG. 4 is its ability to operate as a constant amplitude phase shifter. In other words, the lower frequency components which are coupled across diode 86 are not lost to output 100. Instead, the lower frequency components are reflected at node 96 through the collector current of transistor 88 as out of phase low frequency components. Inverting amplifier 92 thus sums the in phase and out of phase components. It can be shown that the absolute magnitude of a gain of amplifier 92 is independent of frequency below and above $\frac{1}{2}$ Rdyn Cgo and that only the phase of the output voltage is shifted as a function of frequency. Therefore, it can now be appreciated that the phase of a complex input signal to the circuit of FIG. 4 may be altered by altering the bias point of the dynamic resistance of diode 86.

Figure 6:
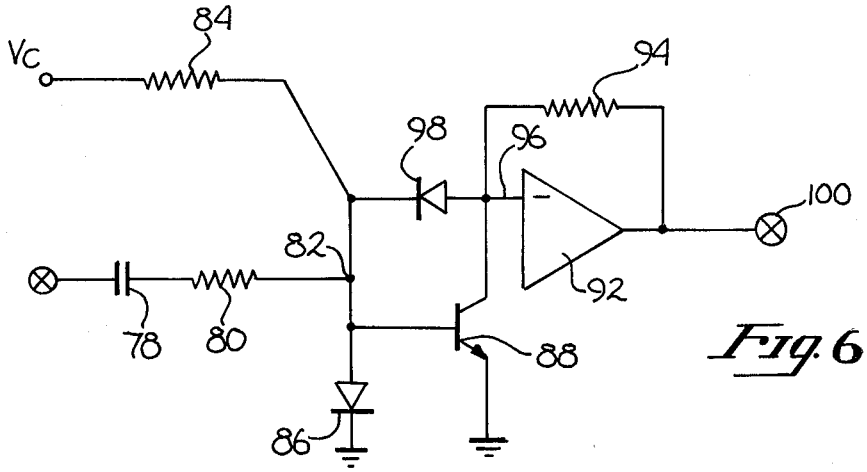
FIG. 6 is a schematic of another embodiment of the present invention wherein a diode is used to couple the inverted input of an amplifier to a current node to produce a voltage controlled waveshaper.

FIG. 6 illustrates another embodiment of the present invention wherein capacitor 90 has been replaced by a diode 98. Operation of this embodiment is substantially similar to the circuit of FIG. 5 except a voltage controlled wave shaper 25 is formed. If Vc is "0" and node 82 is substantially unbiased, positive excursions of voltage are "sunk" or coupled through diode 86 to ground. As previously discussed, such positive excursions will be coupled out of phase to node 96. The inverting node of the amplifier which will then generate a positive voltage excursion at the output. Negative voltage excursions coupled through capacitor 78 and resistor 80 to node 82 will back bias diode 86 off and will forward bias diode 98. Thus, node 96 is again pulled negatively which is reflected through inverting amplifier 92 as a positive voltage excursion at the output. Clearly, the circuit of FIG. 5 is operating in this mode as a full wave rectifier.

However, as Vc becomes more positive, a greater and greater portion of the negative voltage excursions coupled to node 82 are offset by the positive bias. At that point at which the positive bias equals or exceeds the maximum negative voltage excursion, the entire AC input signal will be positively biased and the output of inverting amplifier 92 will track the input in a linear fashion. Thus, the operation of the circuitry of FIG. 5 appears as a linear voltage follower. Therefore, it can readily be appreciated that the output characteristics of the circuitry of FIG. 5 may be gradually transformed through a continuum of states from a full wave rectifier to a linear voltage follower merely by changing the bias voltage Vc.

Thus, either by the circuitry of FIG. 6 or FIG. 5, the output characteristics of the circuit may be altered by alteration of a DC bias potential at node 82. The output of the waveshaping circuit may then be coupled to a conventional voltage controlled audio amplifier 29 as shown in FIG. 2 to produce the desired tones.

Figure 7:
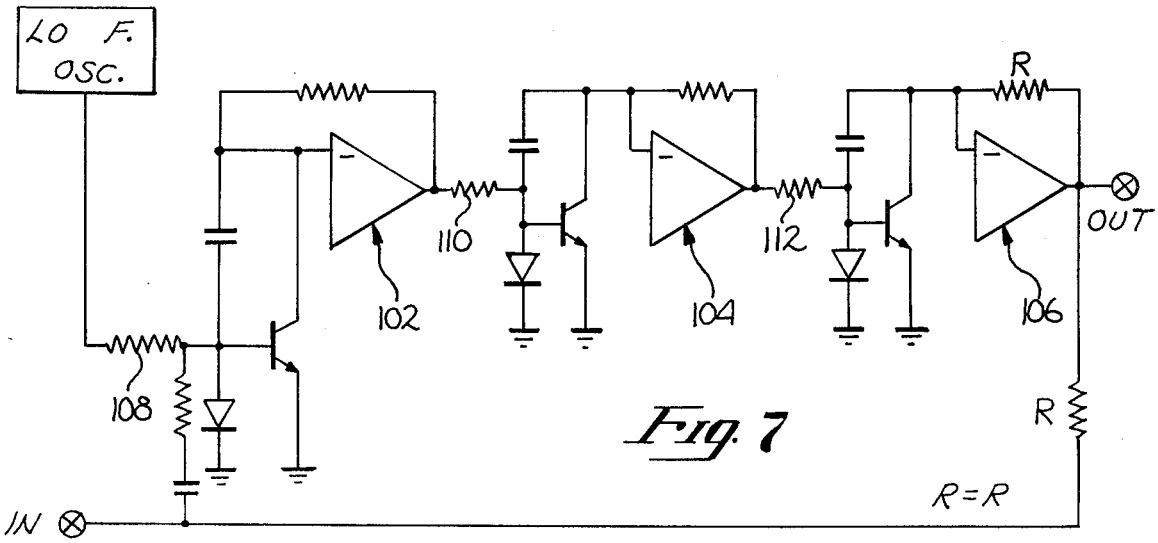
FIG. 7 illustrates the embodiment of the present invention wherein a plurality of circuits, such as set forth in FIG. 3, are coupled in a cascaded series.

FIG. 7 illustrates another embodiment of the present invention wherein the plurality of circuits of the type shown and described in connection with FIG. 5 has been cascaded in an ordered series. The output of each unit circuit is coupled to the input of the next higher ordered unit circuit. For example, circuit 102 has its output coupled to the input of circuit 104, while circuit 104 in turn has its output coupled to the input of circuit 106. The advantage of the circuit is particularly illustrated when it is noted that the DC bias, Vc, could be applied to the input of circuit 102 through input resistor 108 which also serves as the AC path. In such a case, both the AC and DC output of circuit 102 may similarly be coupled through input resistor 110 to the input of circuit 104. Since the cascaded circuits 102, 104 and 106 and any other number, may be formed on a single integrated circuit chip, the AC parameters of the input diodes and transistors of each stage circuit are matched to a high degree. Therefore, values of the input capacitors and feedback resistors may be reliably determined for each stage and result in a phase shifter having an even sounding performance across a wide range of bias voltages. For example, the DC bias voltage may then be modulated, by means well known to the art, over six or more octave ranges which are more than adequate to completely cover musical requisites. Such performance has heretofore been achievable only by careful and painstaking matching of circuit components using discretely variable FET's or opto-couplers.

In addition, the circuitry of FIG. 7 is ideally adapted for interfacing with other electronic devices typically used with musical instruments since the DC bias of the output is necessarily at least one half volt above ground (Vbe) and is entirely compatible with the one volt peak-to-peak signals typically used with musical instrument electronic circuits.

Finally, the phase shifter of the present invention, particularly as illustrated in FIG. 7, will exhibit less distortion than comparable shifters using field-effect transistors since the input of the circuit is essentially a low impedance summing junction that can be fed by a relatively high impedance, typically in excess of 100 K ohms.

It should be understood that many alterations and modifications may be made by those with ordinary skill in the art to the present invention without departing from its scope and spirit. For example, additional DC bias resistors may be coupled to the input summing junction to independently bias the junction from the AC signal path, as essentially shown in FIGS. 4 and 5. In addition, the dynamic impedance of the input diode may still be employed to advantage, such as FIG. 4 by omitting capacitor 90 and substituting a resistor to provide the AC path to the inverting input of amplifier 92. In such cases, it might also be contemplated that a capacitor may be coupled across diode 86 to ground. Further, the variable resistance elements of FIGS. 8 and 9 may be included in the circuitry to effect glides of pitch, tone and volume. For example, a potentiometer 112 may have its rotatable wiper coupled to an axis 114 which in turn has several wraps of string 20 disposed thereon. A sideways displacement of string 20 conventionally used by players to produce a slight glide in pitch or to bend the note would then be reflected by a corresponding change of resistance coupled to the wiper as axis 114 rotates. A spacing between the conductive wire and the conductive frets of such a dimension is chosen which will permit tonal modulation by varying fingure pressure on the fret and wire, and/or by rolling the fingertip back and forth over the fret, to shift the tone from the primary keyed tone to the next highest tone and back. The clearance dimension would be a function of wire tension as well as fretboard geometry, but must be large enough to permit keying a discrete tone without accidental keying of the next higher tone except by deliberate displacement of the wire on opposite sides of the fret. A typical clearance (0.050″) for typical fret height (0.060″) and fret spacing (0.875″) is adequate although many equivalent dimensions could be chosen. In the circuit of FIG. 4, potentiometer 112 may be disposed in series circuit with resistance 64. Known equivalents to potentiometer 112 may also be employed such as shown in FIG. 9. A piezoresistive element 116, well known to the art, may be coupled to a conductive pad 118 and to a conductive string contactor 120. Additional stresses applied to string 20 will strain element 116 and be reflected in a change of impedance. Element 116 may be substituted for potentiometer 112 in FIG. 4 to also bend the note.

I claim:

1. An electronic musical apparatus comprising:

a sound box;

a fret board coupled to said sound box;

a plurality of discrete conductive frets disposed on said fret board;

a plurality of discrete resistive elements coupled to said plurality of discrete conductive frets;

first means coupled to said plurality of resistive elements for generating a first signal having a selected one of a plurality of fundamental frequencies within a range of fundamental frequencies, first signal having a waveshape definable by the sum of a plurality of sine waves having a frequency spectrum;

second means having its input coupled to the output of said first means for selectively modifying the frequency spectrum of sine waves defining the waveshape of the first signal for modifying the waveshape of the first signal without substantially altering the amplitude of the first signal regardless of the fundamental frequency of said first signal within the range of fundamental frequencies;

means for biasing the input of the second means in a range between a first bias extreme and a second bias extreme, said second means selectively obtaining the output characteristics of a full wave rectifier at the first extreme, obtaining the output characteristics of a voltage follower at the second extreme, and obtaining gradations between said first and second extremes;

a source of electrical power; and conductive means disposed on said fret board and adapted to selectively couple said source of electrical power to at least one of said plurality of discrete conductive frets, whereby musical tones may be audibly generated according to a fixed musical scale in a manner functionally equivalent to conventional stringed instruments.

2. An electronic musical apparatus comprising:

a sound box;

a fret board coupled to said sound box;

a plurality of discrete conductive frets disposed on said fret board;

a plurality of discrete resistive elements coupled to said plurality of discrete conductive frets;

first means for generating a plurality of tones coupled to said plurality of resistive elements, said first means generating a periodic current;

a constant amplitude phase shifter having a first node, the periodic current from the first means being coupled to the first node, the phase shifter comprising:

a current differential amplifier, second means coupled between ground and the node for providing a low-resistance path to said periodic current when said periodic current has a first polarity and a high resistance path when said periodic current has a second polarity opposite to said first polarity, third means for providing a selective resistance path coupling the input of said amplifier to said node, and fourth means coupled between the node and the input of the current differencing amplifier for reflecting the periodic current passing through the second means to the input of the amplifier as a periodic signal which is out-of-phase with the periodic current passing through the second means, fifth means for biasing said node to shift said periodic current by a bias current;

second means having its input coupled to the output of said first means for selectively modifying the frequency spectrum of said plurality of tones generated by said first means and for modifying the waveshape, without substantial alteration of amplitude regardless of the frequency of said plurality of tones, said second means selectively obtaining the output characteristics of a full wave rectifier at a first extreme, obtaining the output characteristics of a voltage follower at a second extreme, and obtaining gradiations between said first and second extremes;

a source of electrical power; and conductive means disposed on said fret board and adapted to selectively couple said source of electrical power to at least one of said plurality of discrete conductive frets, whereby musical tones may be audibly generated according to a fixed musical scale in a manner functionally equivalent to conventional stringed instruments.

3. The apparatus of claim 2 wherein said third means is a diode.

4. The apparatus of claim 2 wherein said third means is a capactive element.

5. The apparatus of claim 2 wherein a plurality of said constant amplitude phase shifters and at least one fifth means are employed in an ordered series of cascaded unit circuits, the output of each said constant amplitude phase shifters being coupled to the input of the next higher ordered constant amplitude phase shifter.

6. The apparatus of claim 2 wherein said bias current is audio frequency modulated.

7. In a musical instrument, a circuit comprising:

a plurality of discrete resistive elements, each having a contact node coupled thereto;

conductive wire means for selectively coupling with at least one of said contact nodes;

an oscillator coupled to said plurality of discrete resistive elements and said conductive wire means to selectively generate a plurality of periodic electric signals each having a distinct principal frequency and a distinct waveshape definable by a combination of a plurality of sine waves having a frequency spectrum;

tone enhancement means for selectively altering the frequency spectrum of the plurality of sine waves defining the waveshape for modifying the waveshape without substantially altering the amplitude of the periodic electrical signals regardless of the principal frequency, said tone enhancement means having an input coupled to the output of said oscillator and including:

an amplifier having an input, an input diode having a frequency dependent impedance and coupled between ground and the input of the tone enhancement means, and a capacitor coupled between the inputs of the tone enhancement means and the amplifier wherein said periodic electrical signals tend to be frequency split across the impedance of said capacitor and the frequency dependent impedance of said diode means, for inverting and coupling said periodic electrical signals across said diode to said amplifier input; and audio means for generating an audible signal in response to said altered periodic signal coupled to said tone enhancement means.

8. In a musical instrument, a circuit comprising:

a plurality of discrete resistive elements, each having a contact node coupled thereto;

conductive wire means for selectively coupling with at least one of said contact nodes;

an oscillator coupled to said plurality of discrete resistive elements and said conductive wire means to selectively generate a plurality of periodic electrical signals each having a distinct principal frequency; and a distinct waveshape definable by a combination of a plurality of sine waves having a frequency spectrum;

tone enhancement means for selectively altering the frequency spectrum of the plurality of sine waves defining the waveshape for modifying the waveshape of the periodic electrical signals without substantially altering the amplitude of the periodic electrical signals regardless of the principal frequency, said tone enhancement means having an input coupled to the output of said oscillator and including:

an amplifier having an input, a first input diode coupled between ground and the input of the tone enhancement means and having a first preferred direction of conductivity, and a second input diode coupled between the input of the amplifier and the tone enhancement means input, said second input diode having a second preferred direction of conductivity opposite to said first direction, a source of variable bias voltage coupled to the input of the tone enhancement means, and means coupled between the first diode and the amplifier input for inverting and coupling the voltage across said first diode to said amplifier; and audio means for generating an audible signal in response to said altered periodic signal coupled to said tone enhancement means.

9. In a musical instrument, a circuit comprising:

a plurality of discrete resistive elements, each having a contact node coupled thereto;

conductive wire means for selectively coupling with at least one of asid contact nodes;

an oscillator coupled to said plurality of discrete resistive elements and said conductive wire means to selectively generate a plurality of periodic electrical signals each having a distinct principal frequency; and a distinct waveshape definable by the combination of a plurality of sine waves having a frequency spectrum;

tone enhancement means for selectively altering the frequency spectrum of the plurality of the sine waves defining the waveshape of the periodic electrical signals for modifying the waveshape without substantially altering the amplitude of the periodic electrical signal regardless of the principal frequency, said tone enhancement means having an input coupled to the output of said oscillator; and audio means for generating an audible signal in response to said altered periodic signal coupled to said tone enhancement means;

said enhancement means including:

a voltage controlled waveshaping circuit coupled to said oscillator;

a voltage controlled phase shifting circuit coupled to said waveshaping circuit; and a voltage controlled amplifier coupled to said phase shifting circuit; and a variable modulating oscillator having an input selectively coupled to said waveshaping circuit for timbrato, to said phase shifting circuit for phasing, to said voltage controlled amplifier for tremolo and to said oscillator for vibrato modulation.

10. The circuit of claim 9 wherein said waveshaping and voltage controlled amplifier and said oscillator may includes a pressure sensitive means for producing random glides of tone, volume and pitch respectively.

11. The circuit of claim 10 wherein said variable modulation oscillator generates a sub-audio output.

* * * * *

UNITED STATES PATENT AND TRADEMARK OFFICE

CERTIFICATE OF CORRECTION

PATENT NO. : 4,306,480

DATED : December 22, 1981

INVENTOR(S) : Frank Eventoff et al

It is certified that error appears in the above—identified patent and that said Letters Patent is hereby corrected as shown below:

Column 11, lines 41-53, delete "second means having its... and second extremes;"

Column 11, line 64, "capactive" should read --capacitive--.

Column 13, line 15, "asid" should read --said--.

Signed and Sealed this

*Fifth* Day of *October 1982*

[SEAL]

*Attest:*

GERALD J. MOSSINGHOFF

*Attesting Officer* *Commissioner of Patents and Trademarks*